US005451727A

United States Patent [19]

Park

[11] Patent Number: 5,451,727

[45] Date of Patent: Sep. 19, 1995

[54] NOISE SUPPRESSING APPARATUS FOR HERMETIC RECIPROCATING COMPRESSOR

[75] Inventor: Sung K. Park, Seoul, Rep. of Korea

[73] Assignee: Goldstar Co., Ltd., Rep. of Korea

[21] Appl. No.: 170,617

[22] Filed: Dec. 20, 1993

[30] Foreign Application Priority Data

Dec. 21, 1992 [KR] Rep. of Korea ..... 25992

[51] Int. Cl.[6] ..... F02M 35/00

[52] U.S. Cl. ..... 181/229; 181/403; 417/312

[58] Field of Search ..... 181/229, 403, 232; 417/312, 902

[56] References Cited

U.S. PATENT DOCUMENTS

| | | | |
|---|---|---|---|
| 3,689,203 | 9/1972 | Vaughn | 417/902 X |
| 4,086,032 | 4/1978 | Nishioka et al. | 417/902 X |
| 4,411,600 | 10/1983 | Itagaki et al. | 417/312 |
| 4,531,894 | 7/1985 | Kawai et al. | 417/312 |
| 4,730,695 | 3/1988 | Bar | 181/228 X |
| 5,248,168 | 9/1993 | Chichester et al. | 285/49 |
| 5,252,035 | 10/1993 | Lee | 417/312 |
| 5,288,212 | 2/1994 | Lee | 417/312 |

*Primary Examiner*—Khamh Dang

*Attorney, Agent, or Firm*—Ostrolenk, Faber, Gerb & Soffen

[57] ABSTRACT

A noise suppressing apparatus for a hermetic reciprocating compressor. A soundproof chamber is provided at a lower shell. A suction pipe passes through the soundproof chamber and is divided into inner and outer suction pipes spaced from each other in the soundproof chamber. The inner suction pipe is connected to a suction muffler in such a manner that the inner end of the inner suction pipe is inserted in a spring, and a resilient member is formed about the inner end and the spring and inserted into the suction muffler. Thus the apparatus can diminish noise as well as heat transfer, thereby achieving high efficiency.

3 Claims, 3 Drawing Sheets

NOISE SUPPRESSING APPARATUS FOR HERMETIC RECIPROCATING COMPRESSOR

BACKGROUND OF THE INVENTION

1. Field of the Invention

The present invention relates to a hermetic reciprocating compressor, and more particularly to a noise suppressing apparatus for a hermetic reciprocating compressor which can obtain high efficiency by reducing noise generating from lower shell and by preventing heat from being transmitted a suction muffler during suction.

2. Description of the Prior Art

Referring to FIGS. 1 and 2, there is shown a conventional hermetic reciprocating compressor. As illustrated in the drawing, the hermetic reciprocating compressor includes a hermetic container 3 having a lower shell 1 and an upper shell 2 integrally formed with the lower shell 1. A frame 4 is disposed in inner space defined between the lower and upper shells 1 and 2 and secured to the lower shell 1 at its opposite ends. A driving motor part 5 is mounted below the frame 4, and a compressing part 6 is mounted on the frame 4.

The driving motor part 5 comprises a crank shaft 7 rotatably supported in a center position of the frame 4, a rotor 8 secured to the crank Shaft 7 and a stator 9 supported on a lower surface of the frame 4. The compressing part 6 comprises a cylinder 10 supported on an upper surface of the frame 4 and a piston 11 operatively connected at its outer end to the crank shaft 7 via a slider 19 and reciprocating in the cylinder 10.

The crank shaft 7 is provided at its lower end with a propeller 14 which is adapted to supply upwardly cooling oil 12 reserved in the lower shell 1 through an inner hole *7a* formed in the crank shaft 7.

The lower shell 1 is also provided at its suitable wall with a suction pipe 15. The cylinder 10 is coupled at its rear end to a head with a suction valve 16, a valve seat 17 and an exhaust valve 18 interposed therebetween. In the drawing, numeral 20 denotes a spring.

In operation of the above-described hermetic compressor, upon being applied with electric power, the crank shaft 7 is rotated by induction magnetic action between the rotor 8 and the stator 9 which comprise the driving motor part 5. As the crank shaft 7 is rotated, the piston 11 is linearly reciprocated within the cylinder 10 according to the principle of scotch yoke so that refrigerant is sucked in, compressed and discharged repeatedly.

That is, the refrigerant is sucked in the cylinder 10 through a suction muffler 21 (see FIG. 2) and then compressed by the piston 11. The compressed refrigerant is discharged through an exhaust muffler 22 (see FIG. 2).

As the crank shaft 7 is rotated, the propeller 14 provided at the lower end of the crank shaft 7 is rotated so that the cooling oil 12 contained in the lower shell 1 is raised along the inner hole *7a* of the crank shaft 7 and supplied to the compressing part 6.

In the conventional hermetic reciprocating compressor, since suction gas is fully filled in the inner space defined by the upper and tower shells 2 and 1 and then sucked in, and a flowing path along which refrigerant gas is sucked and discharged is too long, the gas may be overheated. For this reason, the gas is increased in specific volume and lowered in density, thereby decreasing heat efficiency.

For this reason, the structure of the integral head cover 13 as shown in FIG. 2 was modified into a structure as shown in FIG. 3 wherein the integral head cover 13 is divided into a separated head cover 13' and a separated suction muffler 21' and a suction pipe is connected to the suction muffler 21'. However, the modified structure is also not suitable to a low noise structure.

SUMMARY OF THE INVENTION

It is, therefore, an object of the present invention to provide a noise suppressing apparatus for a hermetic reciprocating compressor in which a suction pipe is divided into two suction pipes spaced from each other and the inner pipe of the two pipes is integrally connected to a suction muffler so as to diminish noise and heat transfer and enhance performance of the compressor.

The above-mentioned objects of the present invention can be accomplished by providing a noise suppressing apparatus for a hermetic reciprocating compressor, the compressor comprising a hermetic container consisting of lower and upper shells, a driving motor part mounted bellow a frame disposed inside of the container, and a compressing part mounted on the frame, the noise suppressing apparatus comprising: a soundproof chamber provided at the lower shell; a suction pipe passing through the soundproof chamber and connected to a suction muffler for sucking refrigerant gas into the container; and vibroisolating means provided between the suction muffler and the suction pipe for preventing vibration of and direct contract between the suction muffler and the suction pipe.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

A noise suppressing apparatus for a hermetic reciprocating compressor according to the present invention will be now described in detail with reference to FIGS. 4 to 6.

Figure 1:
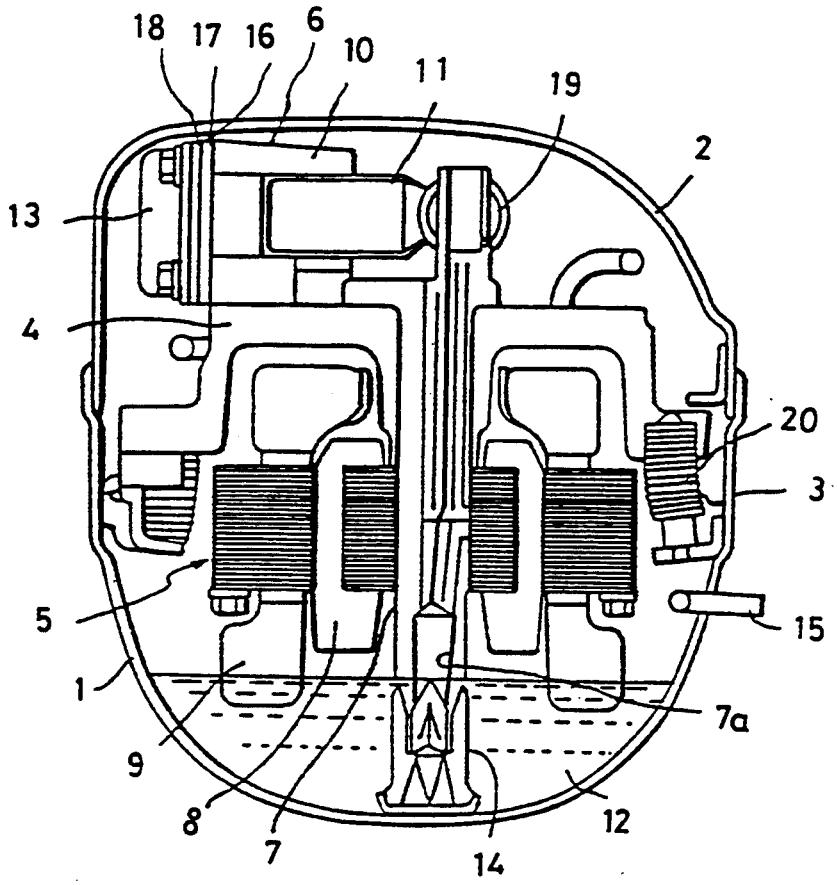
FIG. 1 CONVENTIONAL ART
FIG. 1 is a cross-sectional view of a conventional hermetic reciprocating compressor.
Figure 2:
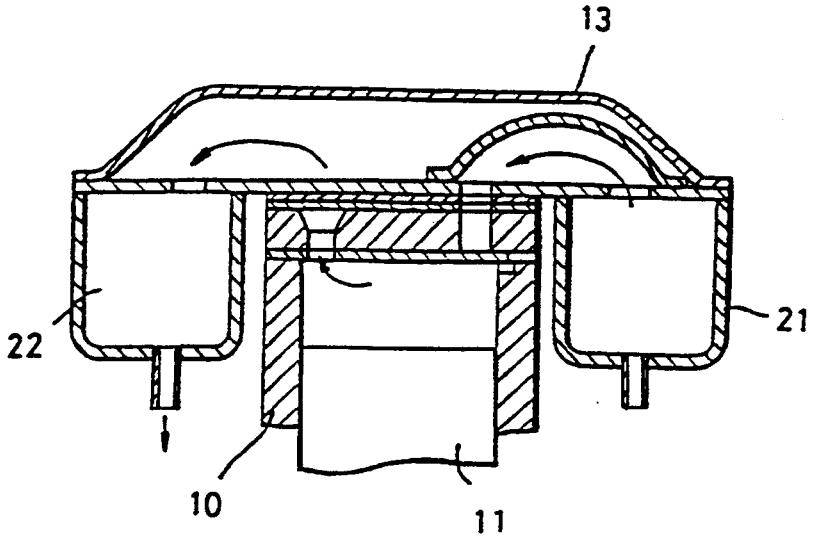
FIG. 2 CONVENTIONAL ART
FIG. 2 is an enlarged cross-sectional view of a head part of the conventional compressor as shown in FIG. 1.
Figure 3:
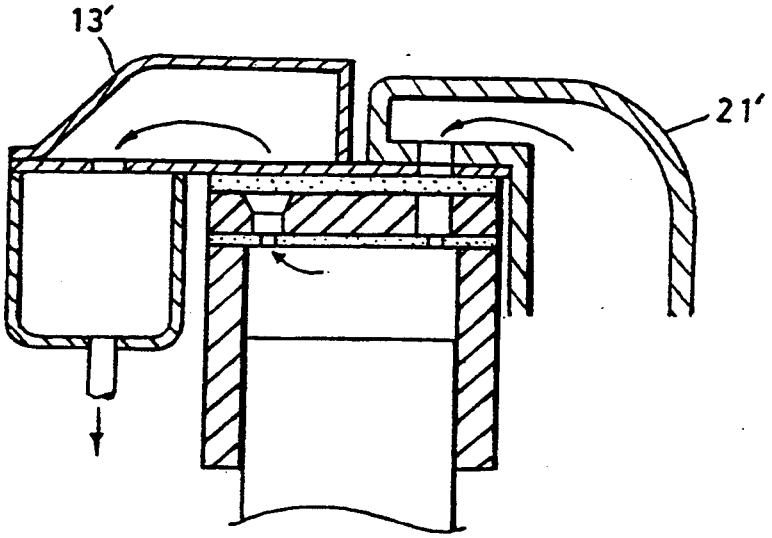
FIG. 3 CONVENTIONAL ART
FIG. 3 is a view similar to FIG. 2, which shows another type of head part of the conventional compressor.
Figure 4:
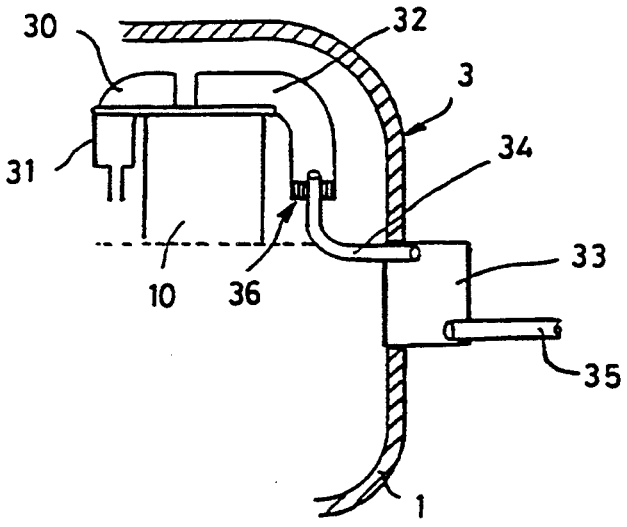
FIG. 4 is a cross-sectional view of a noise suppressing apparatus for a hermetic reciprocating compressor according to an embodiment of the present invention.

Referring to FIG. 4, there is shown a cross-sectional view showing the noise suppressing apparatus according to the present invention. As shown in the drawing, a lower shell 1 is integrally coupled to an upper shell 2 to form a hermetic container 3. A separated head cover 30 is mounted on an upper end of a cylinder 10 disposed in the hermetic container 3. Also, the cylinder 10 is provided with an exhaust muffler 31 to be connected to the head cover 30 and provided with a suction muffler 32 thereon.

The lower shell 1 is provided with a soundproof chamber 33 which is secured within an opening in the lower shell 1, so as to extend outwardly therefrom. As seen in FIG. 4, the chamber 33 is considerably larger than the inner and outer suction pipes 34 and 35. Accordingly, the cross-sectional path of the refrigerant gas is increased, thereby decreasing the noise of the refrigerant gas entering the compressor. The soundproof chamber 33 is provided with a suction pipe to be passed therethrough. In this case, the suction pipe is divided into an inner suction pipe 34 and an outer suction pipe 35. The inner and outer suction pipes 34 and 35 are spaced from each other and disposed to be staggered from each other.

Figure 5:
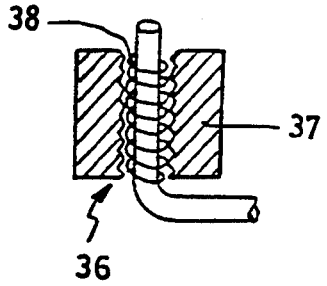
FIG. 5 is an enlarged cross-sectional view of vibroisolating means utilized in the invention.

Referring to FIG. 5, there is shown vibroisolating, i.e., vibration isolating, means according to the invention. The vibroisolating means 36 is connected between the inner suction pipe 34 and the suction muffler 32 to prevent vibration of and direct contact between the inner pipe 34 and the suction muffler 32. More specifically, the inner pipe 34 is inserted into a spring 38, a resilient member 37 such as a rubber is sealingly formed about the inner pipe 34 and the spring 38. The resilient member 37 is sealingly inserted into the free end of the suction muffler 32.

Figure 6:
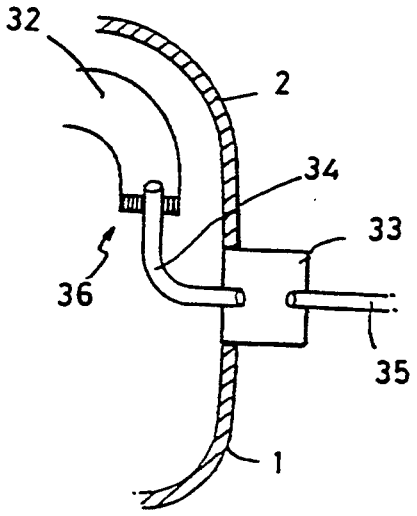
FIG. 6 is a cross-sectional view of a noise suppressing apparatus for a hermetic reciprocating compressor according to another embodiment of the invention.

Referring to FIG. 6, there is shown suction pipes according to another embodiment of the invention. In this embodiment, the inner and outer suction pipes 34 and 35 are disposed to be aligned with each other differently from the first embodiment shown in FIG. 4.

In operation, when refrigerant gas of low temperature and pressure is passed through the soundproof chamber 33 from an evaporator, since the refrigerant gas is passed through the separated outer and inner pipes 34 and 35, noise is diminished. Furthermore, since the compressor of the invention adopts a direct suction manner, that is, since refrigerant gas is directly sucked in the cylinder through the suction muffler 32 which is disposed on the same line as that on which the head cover 30 disposed, heat transfer is decreased and thus efficiency is enhanced.

As apparent from the above description, since the noise suppressing apparatus for a hermetic reciprocating compressor is provided with the enlarged soundproof chamber at its lower shell, and the inner and outer suction pipes are disposed in the soundproof chamber to be separated from each other, noise generating from the suction pipes can be diminished. In addition, the soundproof structure is formed as a part of the lower shell so that it is exposed to outside air to emit a large quantity of heat and is directly connected to the suction muffler disposed beside the head cover, heat transfer is decreased during suction, thereby achieving high efficiency.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A noise suppressing apparatus for a hermetic reciprocating compressor, the compressor comprising a hermetic container consisting of a lower shell having an opening and an upper shell, a driving motor part mounted below a frame disposed inside of the container, and a compressing part mounted on the frame, said noise suppressing apparatus comprising:

a soundproof chamber provided in the opening of the lower shell and extending outwardly from the lower shell;

a suction muffler connected to the compressing part;

a suction pipe means passing through the soundproof chamber and connected to the suction muffler for sucking refrigerant gas into the container; and vibration isolating means provided between the suction muffler and the suction pipe means for preventing vibration of and direct contact between the suction muffler and the suction pipe.

2. A noise suppressing apparatus in accordance with claim 1, wherein said suction pipe means includes inner and outer pipes spaced from each other in the soundproof chamber, the inner pipe having an inner end.

3. A noise suppressing apparatus in accordance with Claim 2, wherein said vibration isolating means comprises a spring inserted on an inner end of the inner suction pipe, and a resilient member sealingly formed about the inner end and the spring and fixedly inserted in the suction muffler.

* * * * *